US006718738B2

(12) United States Patent
Huseman

(10) Patent No.: US 6,718,738 B2
(45) Date of Patent: Apr. 13, 2004

(54) PLASTIC FILM BAG ASSEMBLY AND PROCESS OF FILLING

(75) Inventor: David C. Huseman, Brentwood, TN (US)

(73) Assignee: Packaging Innovations, Inc., Nashville, TN (US)

( * ) Notice: Subject to any disclaimer, the term of this patent is extended or adjusted under 35 U.S.C. 154(b) by 54 days.

(21) Appl. No.: 09/859,079

(22) Filed: May 16, 2001

(65) Prior Publication Data

US 2002/0170274 A1 Nov. 21, 2002

(51) Int. Cl.[7] ..... B65B 9/00

(52) U.S. Cl. ..... 53/459; 53/572; 383/9; 383/200; 383/201

(58) Field of Search ..... 53/412, 413, 459, 53/572, 133.3, 133.4, 139.2; 206/554; 383/9, 200, 201, 204, 207, 209

(56) References Cited

U.S. PATENT DOCUMENTS

| | | | | |
|---|---|---|---|---|
| 3,312,339 A | | 4/1967 | Million | |
| 3,353,661 A | * | 11/1967 | Membrino | 206/554 |
| 4,503,561 A | | 3/1985 | Bruno | |
| 4,557,384 A | | 12/1985 | Membrino | |
| 4,560,068 A | | 12/1985 | Membrino | |
| 4,699,607 A | | 10/1987 | Lambrecht | |
| 4,734,148 A | | 3/1988 | Meyer | |
| 4,769,125 A | * | 9/1988 | Roen et al. | 206/554 |
| 4,769,126 A | | 9/1988 | Roen et al. | |
| 4,849,090 A | | 7/1989 | Case et al. | |
| 4,854,451 A | | 8/1989 | Jensen | |
| 5,062,716 A | | 11/1991 | Conrad et al. | |
| 5,100,000 A | | 3/1992 | Huseman | |
| 5,226,858 A | * | 7/1993 | Snowdon | 206/554 |
| 5,419,437 A | | 5/1995 | Huseman | |
| 5,590,784 A | * | 1/1997 | Daniels | 206/554 |
| 5,601,369 A | | 2/1997 | Moseley et al. | |
| 5,775,511 A | | 7/1998 | Stark | |
| 5,927,660 A | | 7/1999 | McNerney et al. | |
| 5,971,155 A | | 10/1999 | Liang | |
| 6,007,244 A | | 12/1999 | Dinder | |
| 6,012,844 A | | 1/2000 | Huseman et al. | |
| 6,363,694 B1 | * | 4/2002 | Riedinger | 53/572 |
| 6,601,707 B2 | * | 8/2003 | DeSmedt | 383/9 |

* cited by examiner

*Primary Examiner*—John Sipos
*Assistant Examiner*—Louis Huynh
(74) *Attorney, Agent, or Firm*—George Pappas

(57) ABSTRACT

A plastic film bag assembly includes a bag having front and back walls joined together and defining an opening leading to a cavity. A header portion extends from the back wall for supporting the bag on a structure. A severance line extends across the header and includes tear sections extending inwardly from each of the header side edges. The severance line also includes support sections adjacent and inwardly of the tear sections. The support sections have a strength per unit length of severance line which is greater than the tear sections strength per unit length of severance line whereby, when severing the bag away from the header, a greater force is required for severing along the severance line support sections than the force required for severing along the tear sections. In use, the bag front wall lip is grasped and pulled away from the header for separating complementary profiles and opening the bag. The header tear sections are severed until reaching the support sections. The bag is retained open by continued pulling on the lip with a force insufficient for severing the support sections. Product is then placed in the bag and the lip is pulled with a sufficiently greater force for severing along the severance line support sections thereby severing the bag away from the header. For use in temporarily storing produce, the bags include a gusset for expansion and holes through the bag front and back walls for allowing air to enter the bag cavity.

12 Claims, 6 Drawing Sheets

PLASTIC FILM BAG ASSEMBLY AND PROCESS OF FILLING

TECHNICAL FIELD

The present invention relates to plastic film bags and processes of filling the bags with product. More particularly, the present invention relates to a plastic film bag assembly and process of filling wherein the bag is severable from a header portion in a manner whereby, during severing, the bag is retained open for filling with product.

BACKGROUND OF THE INVENTION

Plastic film bags are today commonly and widely used in various applications from temporarily or semi-permanently storing many different products such as, for example, foods, electronic equipment, mechanical components, specimens, etc. Such bags are generally made of a thin film of plastic and range in size and holding capacity. When such bags are individually used for manually placing products or goods therein, it is desirable for such bags to be provided in packs of large quantities and to easily and readily be individually dispensable therefrom. When manually filling, it is also desirable that the bags be temporarily retained open for placing product therein. Bags of this character are particularly useful in vegetable and fruit packaging, delis and manufacturing when the bags are individually filled with product ranging from nuts and bolts to meats, cookies and grapes.

A prior individually fillable and dispensable bag assembly is disclosed in Huseman, U.S. Pat. No. 5,100,000 wherein plastic film bags include a header portion used for suspending the bags on a support structure. A perforation line extends across the header whereat the bag is selectively detachable from the header. A hole is provided in the header below the perforation for receiving a peg on the support structure. The bags are used by pulling on the front wall lip and opening the bag and causing the header to be severed along the perforation line inwardly from the header side edges. The bag is then supported on the peg while placing product in the bag and, thereafter, the bag is lifted off of the peg and severed along the remaining perforation line for detaching the bag from the header. Additional examples of individually dispensable and fillable bags are shown and disclosed in Roen et al., U.S. Pat. No. 4,769,126; Liang, U.S. Pat. No. 5,971,155; Conrad et al., U.S. Pat. No. 5,062,716; Bruno, U.S. Pat. No. 4,503,561; Huseman, U.S. Pat. No. 5,419,437; Dinder, U.S. Pat. No. 6,007,244; Lambrecht, U.S. Pat. No. 4,699,607; Meyer, U.S. Pat. No. 4,734,148; and, Jensen U.S. Pat. No. 4,854,451.

Although the plastic film bag assemblies of the prior art are capable of being individually filled and dispensed, they are not without shortcomings and draw backs. For example, the use of pegs for supporting the bag while filling requires the user to lift the bag in a somewhat precise manner to remove from the peg thereby decreasing efficiency and increasing the filling time. The use of support pegs further requires specific alignment of the holes for placement on the support pegs and, further, the support structure must be constructed with sufficient precision placing the support peg at the proper location for alignment with the bag holes for proper use.

SUMMARY OF THE INVENTION

An object of the present invention is to overcome the above discussed disadvantages and drawbacks associated with prior individually fillable and dispensable plastic film bag assemblies.

Another object of the present invention is to provide a plastic film bag assembly wherein the bags are selectively individually fillable and dispensable quickly and efficiently and without the use of support pegs.

Briefly, the present invention is directed to a new and improved plastic film bag assembly including a plastic film bag having front and back walls defining a cavity therebetween and an opening leading to the cavity. A header portion extends from the back wall whereby the bag can be supported on a support structure or the like. A severance line extends across the header portion whereat the bag can be selectively severed from the header portion. Preferably, the severance line extends across and between the header side edges. The severance line includes sides tear sections inwardly from and adjacent each of the side edges, support sections adjacent each of the sides tear sections, and a tear section between the support sections. The severance line support sections have a first strength per unit length of severance line and the tear line sections have a second strength per unit length of severance line. The first strength per unit length is greater than the second strength per unit length so that, when severing the bag away from the header along the severance line, a greater force is required for severing along the support sections than the force required for severing along the tear sections.

Preferably, complementary detachably attachable zipper profiles are provided on the front and back walls near the bag opening for selectively opening and closing the bag. Additionally, a lip is provided on the front wall whereat the bag can be grasped and pulled away from the header for severing the bag from the header. For storing produce and other items requiring air, preferably the front and/or back walls are provided with a plurality of holes. A gusset is also preferably provided between the front and back walls for allowing expansion of the bag cavity when filling with larger or bulkier products.

The present invention is further directed to a process of placing product in the plastic film bag by grasping the bag front wall and pulling the bag away from the header with a first force sufficient for severing along the tear sections and thereby severing the header inwardly from the side edges and along the severance line tear sections. Thereafter, while the bag is attached to the header at the support sections, product is placed through the bag opening and into the bag cavity. For better and more easy handling, the bag and product are preferably supported on a support structure. The bag front wall is then further pulled away from the header with a second force greater than the first force, thereby severing the header along the severance line support sections. Finally, the bag is yet further pulled with a force sufficient for severing the header along the severance line tear section between the support sections, thereby fully severing the bag from the header.

Preferably, a plurality of plastic film bag assemblies are stacked on top of one another making a pack wherein, as each bag is individually filled and dispensed, another bag is exposed for use therebelow in the next filling and dispensing operation. Preferably, each header is attached to two bags on opposite sides thereof forming a saddle, and the saddles are stacked for making a saddle pack. The saddle pack is preferably supported on an A-frame type support structure allowing filling and dispensing of the bags on both sides thereof. Yet more preferably the saddle packs are supported on a support structure including a shelf for supporting each bag when product is placed therein.

In one form thereof, the present is directed to a plastic film bag assembly comprising a plastic film bag including front and back walls defining a cavity therebetween and an opening leading to the cavity. A header portion extends from the back wall whereby the bag can be supported. A severance line extends across the header portion whereat the bag is selectively severable from the header portion. The severance line includes a bag support section and a tear section. The severance line support section has a first strength per unit length of severance line and the tear section has a second strength per unit length of severance line. The first strength per unit length is greater than the second strength per unit length. When severing the bag away from the header along the severance line, a greater force is required for severing along the support section than the force required for severing along the tear section.

In one form thereof, the present invention is directed to a process of placing product in a plastic film bag using a plastic film bag assembly including a plastic film bag having front and back walls defining a cavity therebetween and an opening leading to the cavity. A header portion extends from the back wall. A severance line extends across the header portion whereat the bag is selectively severable from the header portion. The severance line includes a bag support section and a tear section. The severance line support section has a first strength per unit length of severance line and the tear section has a second strength per unit length of severance line. The first strength per unit length is greater than the second strength per unit length. The process includes the steps of grasping the bag front wall and pulling the front wall away from the header with a first force and severing the header along the severance line tear section, placing product through the bag opening and in the bag cavity while the bag is attached to header at the support section, and pulling bag away from the header with a second force greater than the first force and severing the header along the severance line support section and thereby severing the bag from the header.

In one form thereof, the present invention is directed to a process of placing product in a plastic film bag using a plastic film bag assembly including a plastic film bag having front and back walls defining a cavity therebetween and an opening leading to the cavity. A header portion extends from the back wall. A severance line extends across the header portion whereat the bag is selectively severable from the header portion. The header portion includes side edges and the severance line extends therebetween. The severance line includes tear sections adjacent each of the side edges and a support section therebetween. The severance line support section has a first strength per unit length of severance line and the tear section has a second strength per unit length of severance line. The first strength per unit length is greater than the second strength per unit length. The process includes the steps of grasping the bag front wall and pulling the bag away from the header with a first force and severing the header along the severance line tear sections. Product is then placed through the bag opening and in the bag cavity while the bag is attached to the header at the support section. The bag is then further pulled away from the header with a second force greater than the first force and severing the header along the severance line support section and thereby severing the bag from the header.

In one form thereof, the present invention is directed to a process of placing product in a plastic film bag using a plastic film bag assembly including a plastic film bag having front and back walls defining a cavity therebetween and an opening leading to the cavity. A header portion extends from the back wall. A severance line extends across the header portion whereat the bag is selectively severable from the header portion. The severance line includes side tear sections adjacent each of the side edges, support sections adjacent each of sides tear sections and a tear section between the support sections. The severance line support sections have a first strength per unit length of severance line and the tear line sections have a second strength per unit length of severance line. The first strength per unit length is greater than the second strength per unit length. The process includes the steps of grasping the bag front wall and pulling the bag away from the header with a first force and severing the header along the severance line tear sections. Product is then placed through the bag opening and in the bag cavity while the bag is attached to the header at the support sections. The bag is then further pulled away from the header with a second force greater than the first force and the header is severed along the severance line support sections. The bag is then further pulled away form the header severing the header along the severance line tear section between the support sections thereby severing the bag from the header.

BRIEF DESCRIPTION OF THE DRAWINGS

The above mentioned and other features and objects of this invention and the manner of obtaining them will become more apparent and the invention itself will be better understood by reference to the following description of embodiments of the invention taken in conjunction with the accompanying drawings wherein.

The exemplifications set out herein illustrate preferred embodiments of the invention in one form thereof and such exemplifications are not to be construed as limiting the scope of the disclosure or the scope of the invention in any manner.

DETAILED DESCRIPTION OF SPECIFIC EMBODIMENTS

Figure 7:
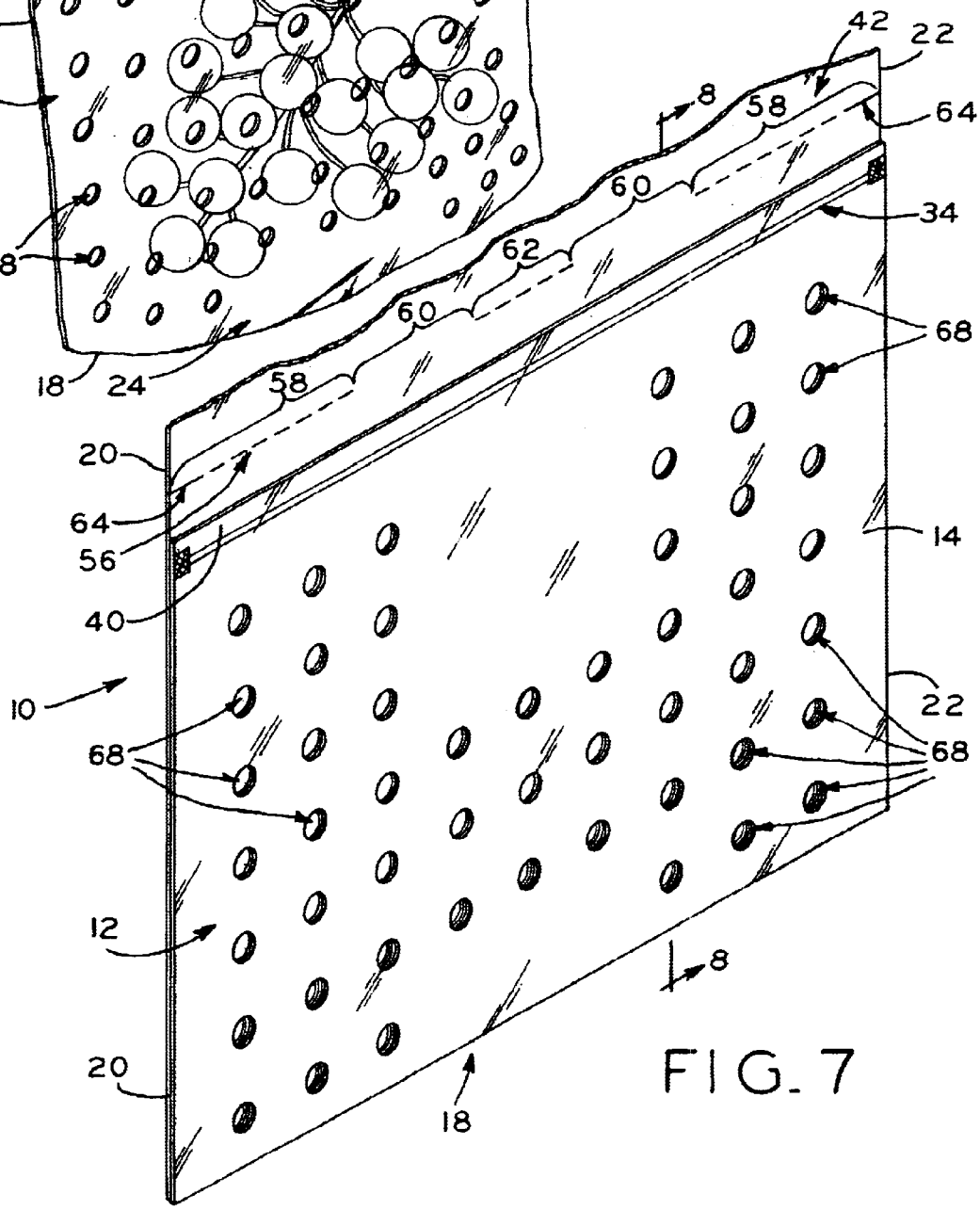
FIG. 7 is a perspective view of a plastic film bag assembly constructed in accordance with the principles of the present invention.
Figures 8, 9:
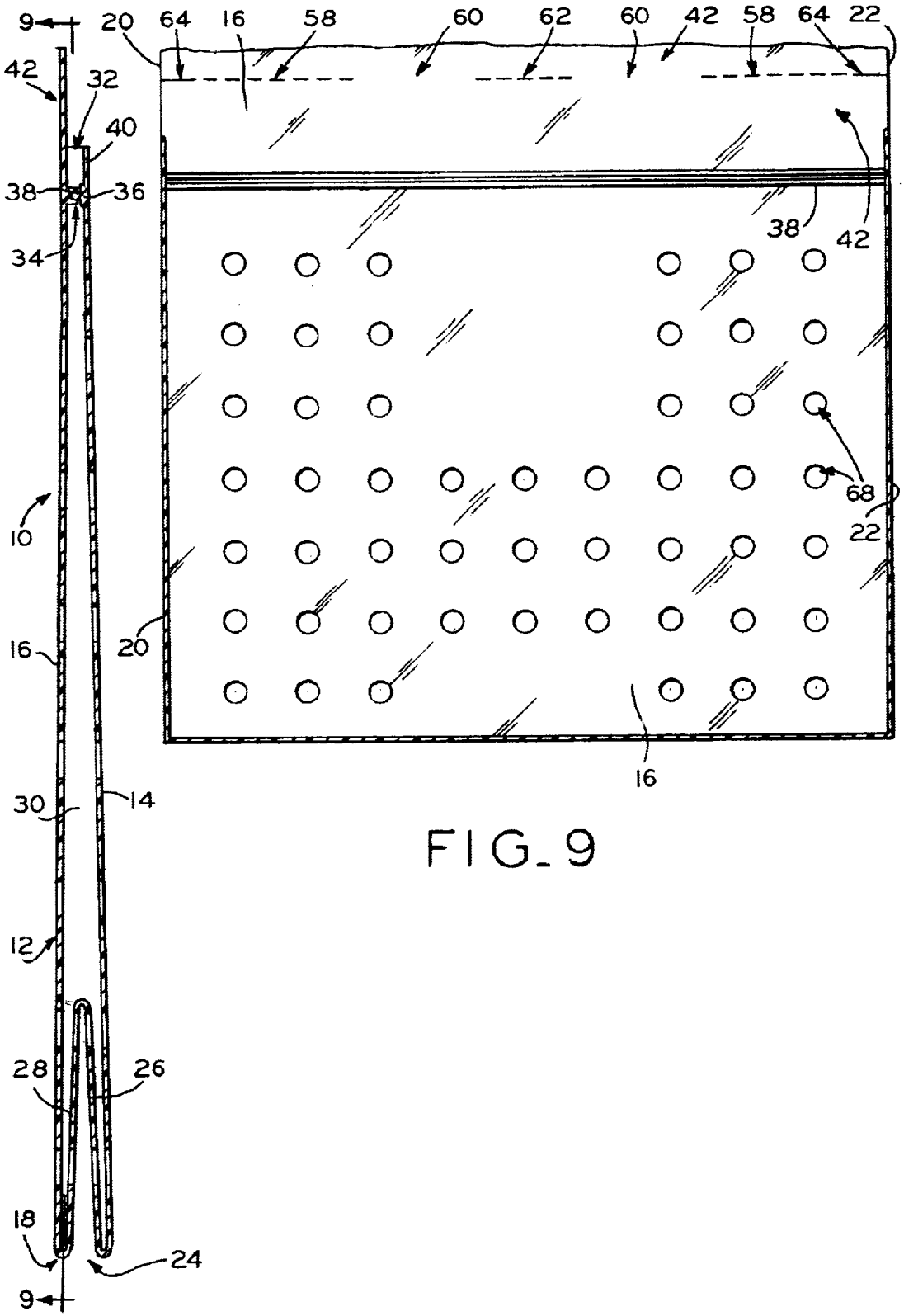
FIG. 8 is a cross sectional view of the assembly shown in FIG. 7 and taken along line 8—8.
FIG. 9 is a cross sectional view of the assembly shown in FIG. 8 and taken along 9—9. Corresponding reference characters indicate corresponding parts throughout the several views of the drawings; and, FIG. 10 is a perspective view similar to FIG. 4 but wherein the bags are supported on a preferred support structure including a shelf; and, FIG. 11 is a perspective view similar to FIG. 5 but again depicting the bags supported on the preferred support structure and further showing the bag and product placed therein being supported on the support structure shelf before the bag is fully severed away from the header.

Referring initially to FIGS. 7 through 9, a plastic film bag assembly constructed in accordance with the principles of the present invention is shown and generally designated by the numeral 10. The plastic film bag assembly 10 includes a bag 12 made up of and including a front wall 14 and a back wall 16 joined together at their lower end 18, left edge 20, and right edge 22. Front and back walls 14 and 16 are joined or attached together by heat sealing or other suitable means or, depending on the manufacturing process, may be integral with one another at one or more of the edges or ends while the other edges or ends may be joined by heat sealing or suitable means. In the preferred embodiment as shown, the front and back walls 14 and 16 are joined at the left and right edges 20 and 22 by heat sealing whereas at the lower end 18 the front and back walls 14 and 16 are integral with one another. Further, a gusset 24 is provided at the bag lower end 18 by folding over sections 26 and 28 which are integral with and located between the front and back walls 14 and 16, as shown in FIG. 8. Sections 26 and 28 as shown are integrally formed with the front and back walls 14 and 16 along their horizontal folds whereas, at their side edges, extend to the bag left and right edges 20 and 22 whereat they are heat sealed and joined to the front and back walls 14 and 16.

Front and back walls 14 and 16 together define a cavity or chamber 30 therebetween whereat various products and things can be placed as desired. The bag cavity 30 is accessible through an opening 32 located generally at the top of the front and back walls 14 and 16 and leading or communicating with the bag cavity 30. As can be appreciated, when product is placed within the cavity 30, sections 26 and 28 of gusset 24 will fold out from between the front and back walls 14 and 16 for expanding and effectively enlarging the size of the bag cavity 30.

Complementary detachably attachable zipper profiles are provided on the front and back walls 14 and 16 as shown and generally designated by the numeral 34. Zipper profiles 34 are located generally at the bag opening 32 for selectively opening and closing the bag 10 and selectively gaining access to the cavity 30. Complementary zipper profiles 34 include a male zipper profile 36 located on the inside surface of the front wall 14 and a female zipper profile 38 located on the inside surface of back wall 16. Male and female zipper profiles 36 and 38 are preferably formed integrally with the front and back walls 14 and 16. In the alternative, male and female zipper profiles 36 and 38 can be formed separately, and thereafter, adhered or otherwise attached to the inside surfaces of the front and back walls 14 and 16. Additionally, the location of the zipper profiles can be reversed such that the male zipper profile is located on the inside surface of the back wall 16 and the female zipper profile 38 is located on the inside surface of the front wall 14. The male and female zipper profiles 36 and 38 are selectively pushed together or separated from one another in a known and customary manner for selective engagement and selective opening and closing of the bag 12 at opening 32.

At the upper end of the front wall 14 there is provided a lip 40. Lip 40 is preferably located above the complementary zipper profiles 34 and extends between the left and right side edges 20 and 22. Lip 40 is further preferably integrally formed with the front wall 14 and, as further discussed hereinbelow, is provided for more easily selectively grasping and severing the bag 12 from the header 42.

Header 42 is preferably integrally formed with and extends upwardly from the back wall 16 or can be attached thereto. Header 42 preferably extends between the left and right side edges 20 and 22 and is used for supporting the plastic film bag 12 in a manner whereby the bag can be filled and, thereafter, severed therefrom.

As best seen in FIGS. 1 through 5, header 42 is preferably provided between two identical bags 12 forming what is commonly known as a saddle. A plurality of saddles are stacked above one another and attached at the header by hot needle heat sealing at holes 44. A central opening 46 is provided through header 42 and an extension 48 is received therethrough for thereby retaining the pack of bags on the A-frame support structure 50. Additional holes 52 and 54 can be provided through the header 42 for heat sealing together the plurality of headers and bags and/or receiving retaining extension pegs of other support structures (not shown).

Each of the headers 42 is provided with a severance line generally depicted by numeral 56 and extending across the header 42 from left side edge 20 to right side edge 22. As more fully described hereinbelow, severance line 56 is provided for selectively severing or detaching the bag 12 from the header 42.

Severance line 56 preferably includes sides tear sections 58 extending inwardly from each of the left and right side edges 20 and 22, support sections 60 adjacent each of the sides tear sections 58 and extending further inwardly, and a central tear section 62 between the support sections 60. As shown, tear sections 58 are preferably a perforated line whereat the severance line 56 can fairly easily be severed. Support sections 60 can be solid sections as shown or, in the alternative, can be perforated with smaller cut through slots for making that section of the severance line substantially more difficult to severe than the tear sections 58. It is noted that the length of support sections 60 relative to the tear sections 58 as shown in the drawings is merely diagrammatic for ease of description and will be varied in length as may be desired by one skilled in the art depending on the thickness and strength of the plastic film and the relative strength desired between the tear sections 58 and support sections 60. In this regard, however, it should be noted that the support sections 60 will always be provided with a strength per unit length of severance line which is greater than the strength of the tear sections 58 per unit length of severance line. In this manner, when severing bag 12 from header 42 along the severance line 56, the force required for severing from each of the side edges 20 and 22 inwardly along the tear sections 58 will be less than the force required for, thereafter, severing along the support sections 60. Preferably each of the tear sections 58 are provided with a starting cut portion 64 extending inwardly from each of the left and right side edges 20 and 22 for more easily starting the severance process along tear sections 58 when the bag 12 is being detached from the header 42.

Severance line 56 further preferably includes a central tear section 62 located between the support sections 60.

Central tear section 62 is preferably perforated similar to the sides tear sections 58 thereby making it easier to sever therealong than the support sections 60. Preferably, central tear section 62 has a strength per unit length of severance line similar to the strength per unit length of the tear sections 58, although it is contemplated that this central tear section 62 can have a differing strength per unit length so long as it is less than the strength per unit length of the support sections 60. If is further contemplated that the central tear section 62 can be eliminated altogether and a support section 60 provided across and between the tear sections 58 for proper operation and use of the plastic film bag assembly 10 as described hereinbelow.

In the preferred embodiment as shown, the plastic film bag 12 is intended for temporarily storing produce such as grapes 66. For this purpose, a plurality of air holes 68 are provided through the front and back walls 14 and 16 thereby allowing air flow to within the bag cavity 30 and any produce that may be contained therein.

Figure 1:
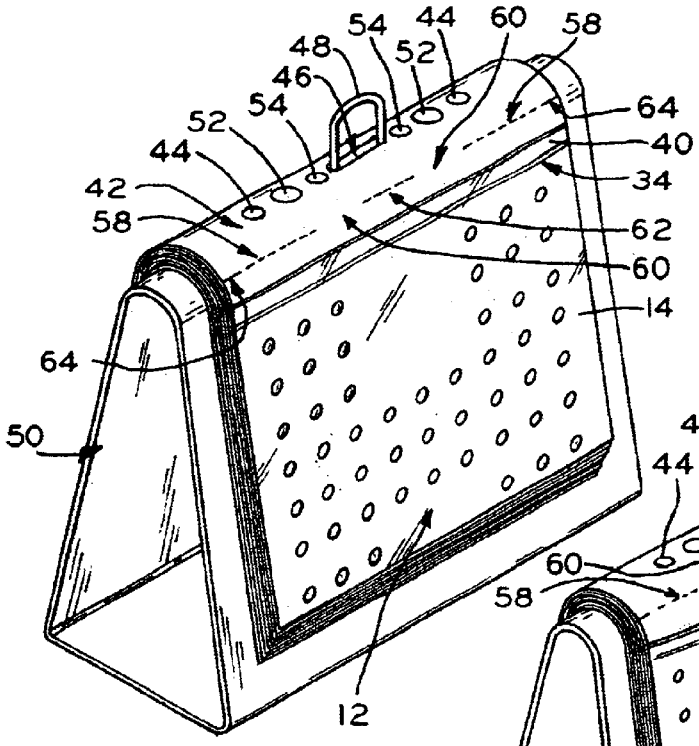
FIG. 1 is a perspective view of a saddle pack of plastic film bag assemblies constructed in accordance with the principles of the present invention and supported on an A frame support structure.
Figure 2:
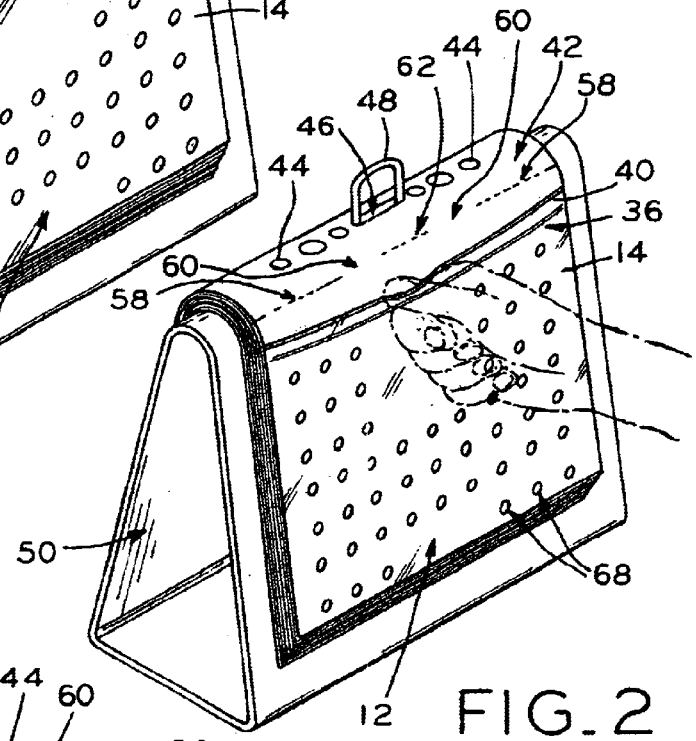
FIG. 2 is a perspective view similar to FIG. 1 and showing a bag front wall lip being grasped for pulling away from the header portion.
Figure 3:
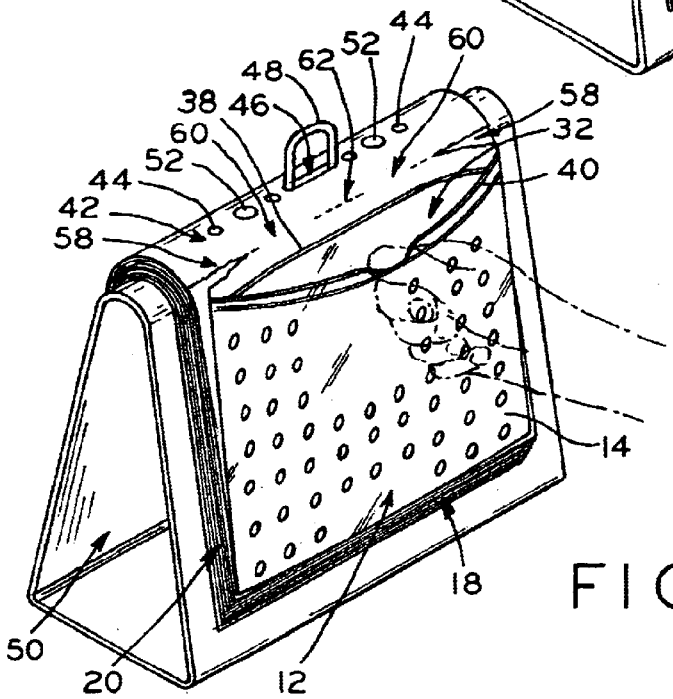
FIG. 3 is a perspective view similar to FIG. 1 and showing the plastic film bag after the front wall lip has been pulled away causing the complementary zipper profiles to be separated and the bag opened, and the severance line tear sections extending inwardly from the header side edges having been severed.
Figure 4:
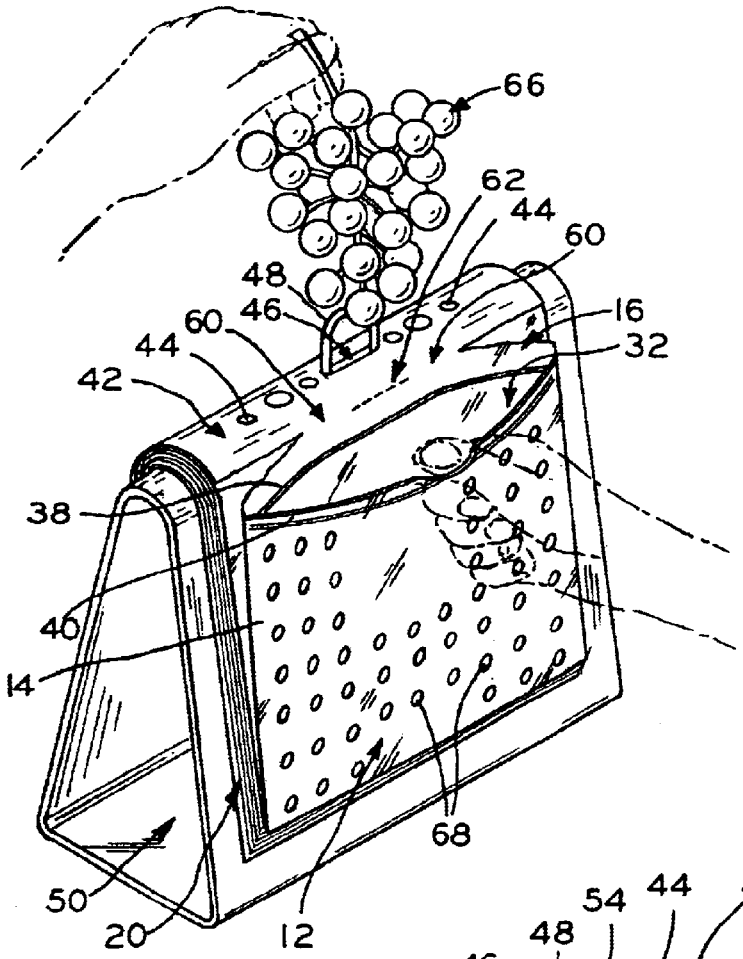
FIG. 4 is a perspective view similar to FIG. 1 and showing the bag opened and continuing to be supported by the severance line support sections while filling the bag with product.
Figure 5:
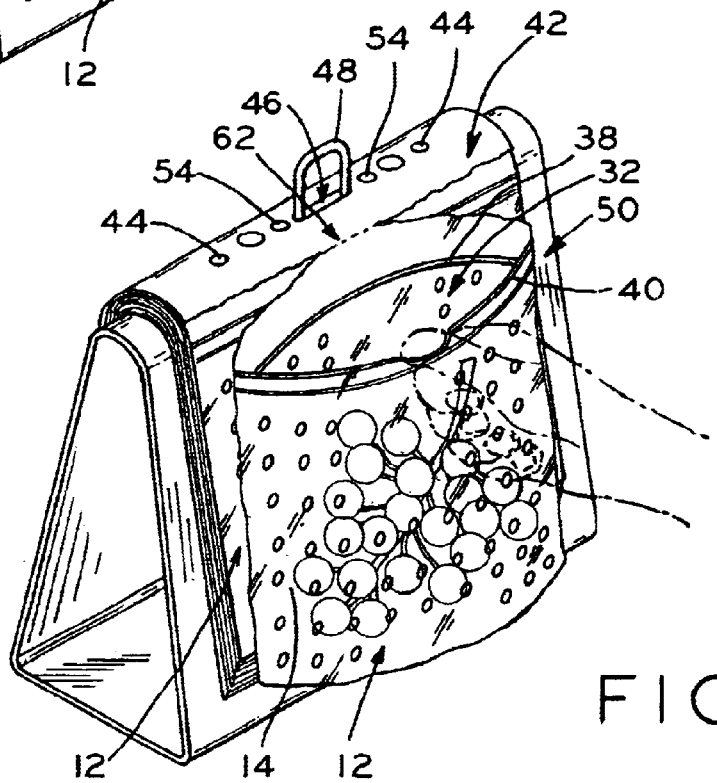
FIG. 5 is a perspective view similar to FIG. 1 showing the bag after the front wall lip has been further pulled with a greater force sufficient for severing the header along the severance line support sections and just prior to severing along the severance line tear section between the support sections.

As shown in FIGS. 1 through 6, the plastic film bag assembly 10 is used for individually placing products such as grapes 66 therein and dispensing or tearing away the bag 12 from the header 42. Preferably, the plastic bag film assemblies are stacked and supported on a support structure such as the A-frame support structure 50 and with the bag front wall 14 on top or exposed as shown. For placing product in the bag 12, the operator merely grasps the bag front wall lip 40 and pulls away from the header 42 as shown in FIG. 2. In this manner, the bag is opened and the header is severed inwardly from each of the left and right side edges 20 and 22 along the tear sections 58 as shown in FIG. 3. Unless the operator is pulling with the greater force required to sever along the support sections 60, the header will be severed along the severance line tear sections 58 until the support sections 60 are reached, at which point the bag 12 can be retained open as depicted in FIG. 4 for placing product such as the grapes 66 therein. It is noted that, preferably, the difference in strength per unit length between the tear sections 58 and support sections 60 is sufficient for the operator to "feel" when the tear sections 58 have been severed and the support sections 60 have been reached. It is further noted that when the bag 12 is provided with complementary zipper profiles as in the preferred embodiment as shown, the zipper profiles which are initially at least partially attached to one another are then further separated for opening the bag sufficiently as, for example, in FIG. 4 for placing product through the bag opening 32 and into the cavity 30. Thus, as depicted in FIGS. 4 and 5, by continuing to pull on the bag front wall lip 40 with a force insufficient for severing along the support sections 60 the bag 12 is retained open and the grapes 66 are placed within the bag cavity 30.

After the product such as the grapes 66 are placed within the bag cavity, the operator then further pulls the bag away from the header 42 with a greater force which is sufficient for severing along the support sections 60. Preferably, the operator merely continues to grasp the front wall lip 40 for pulling and exerts the necessary greater force required for severing along the support sections 60. In this manner the header 42 is further severed along the severance line support sections 60 as depicted in FIG. 5. When a central tear section 62 is used as shown, after having severed through the support sections 60, it becomes easier to fully sever the bag away from the header 42 in view of the smaller force required for severing along the central tear section 62.

As should now be evident, it is preferred that the support sections 60 are sufficiently apart from one another as shown, rather than merely locating a single support section at the center of the severance line, so that, when opened, the bag opening is larger and wider as shown in FIG. 4, rather than elongate as would occur when merely providing a single support section at one location along the severance line such as at the center of the severance line.

Figure 6:
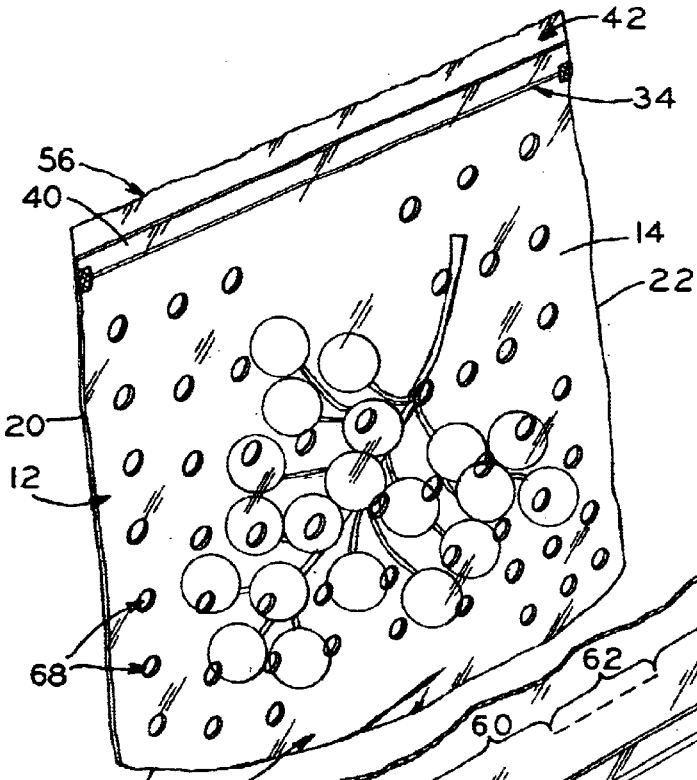
FIG. 6 is a perspective view of a plastic film bag after it has been filled and fully severed from its header and the zipper profiles have been re-attached for closing the bag.

Finally, after the bag 12 has been fully severed away from the header 42 the complementary zipper profiles 36 and 38 are re-attached to one another in a known and customary manner for thereby closing the bag opening with the product such as grapes 66 therein as shown in FIG. 6. Further, by locating the severance line 56 vertically above the front wall lip 40, after one bag in a pack is severed from its header, another therebelow is exposed with the lip 40 thereof readily accessible for grasping by the operator and repeating the process.

Figure 10:
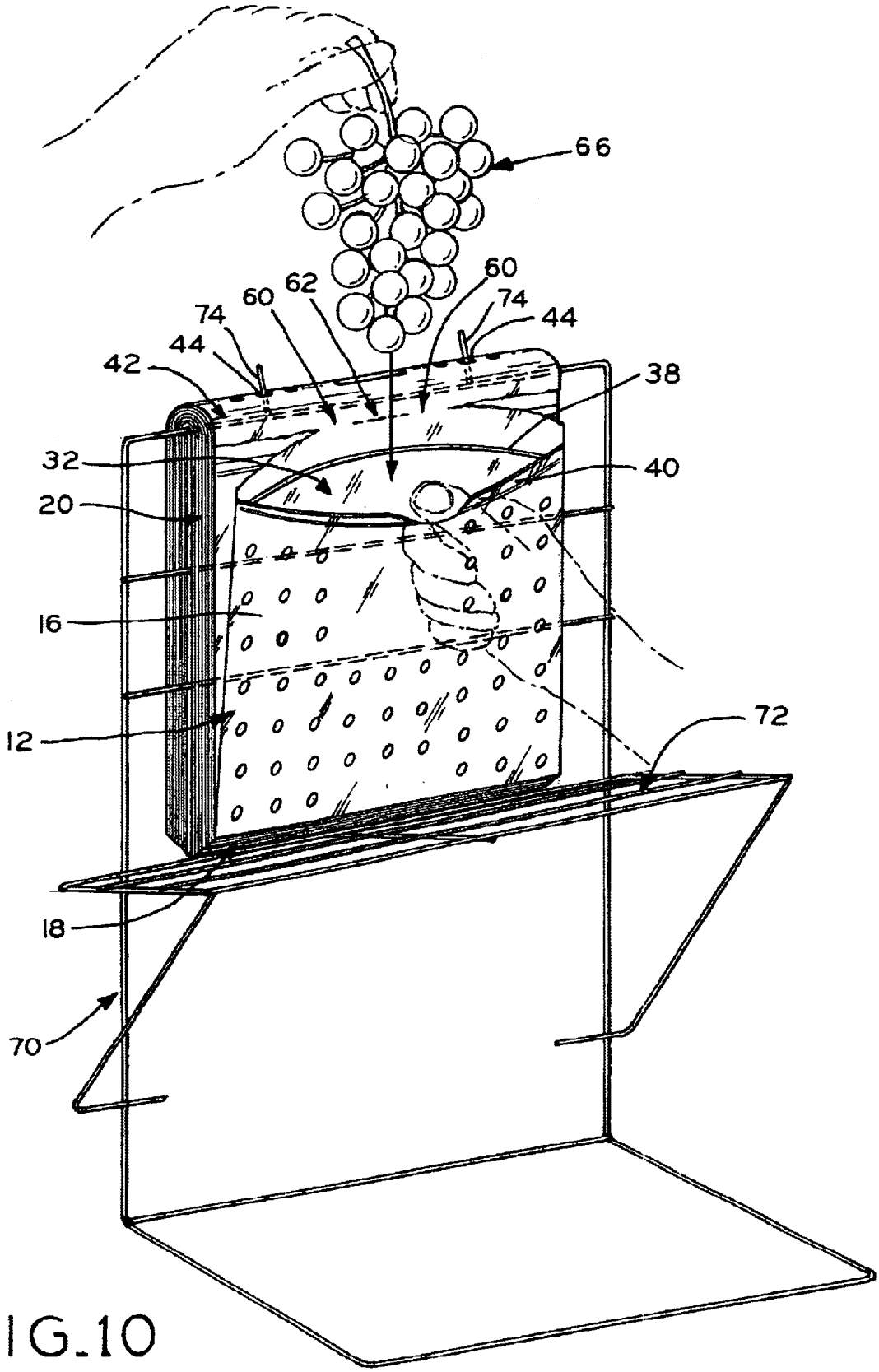
Figure 11:
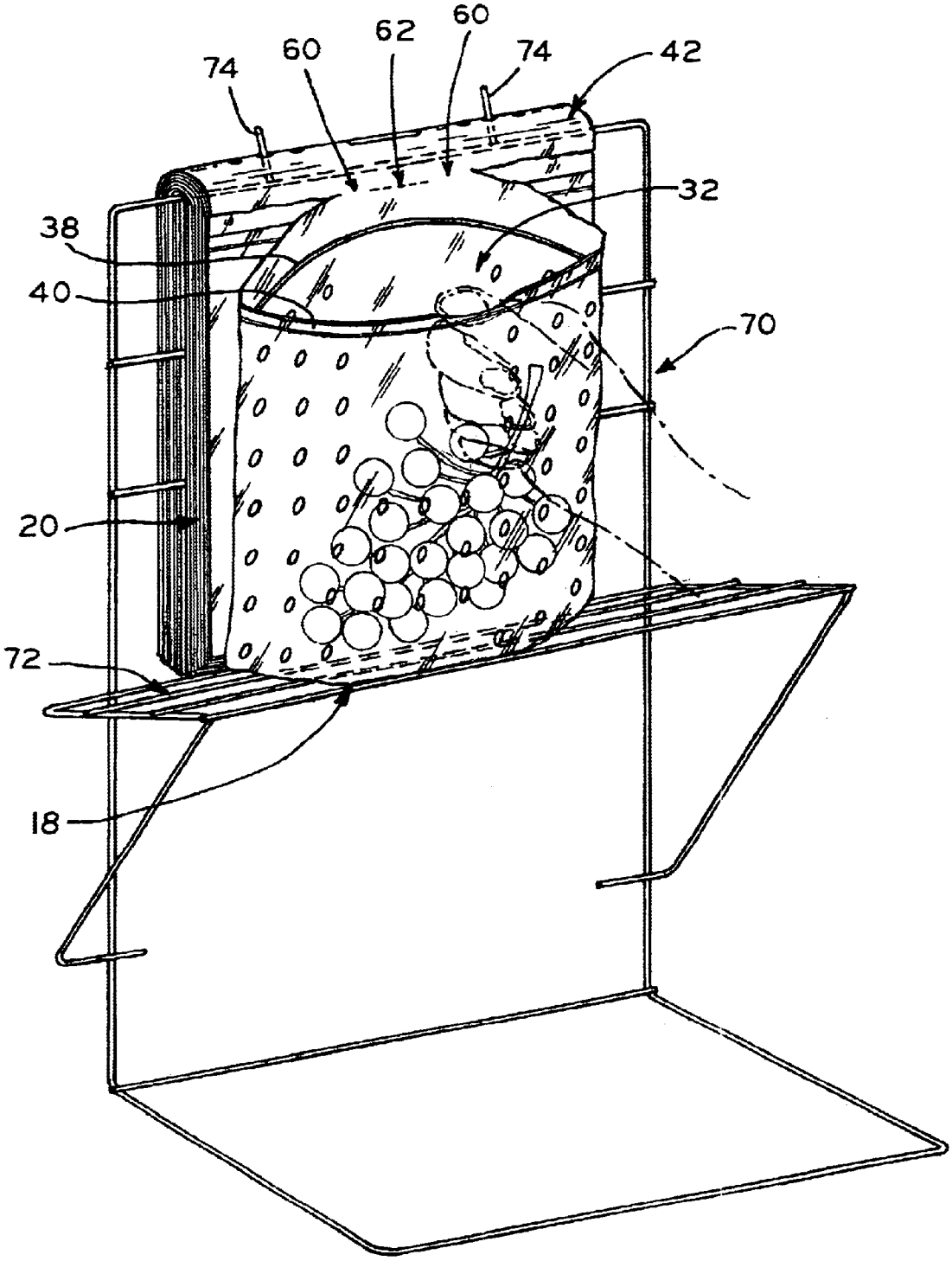

Referring now to FIGS. 10 and 11, in a yet more preferred embodiment in accordance with the principles of the present invention, a saddle pack of bags 12 are supported on a support structure 70. Support structure 70 is made of welded wire as shown and includes a shelf 72 located generally below the bags 12, and further includes positioning pegs 74 adapted to be received through holes 44 in header 42. Bags 12 are filled and dispensed on the support structure 70 in a fashion similar to that described hereinabove with respect to FIGS. 1 through 6. Here, however, after the bag is opened and the header is severed inwardly from each of the left and right side edges 20 and 22 along the tear sections 58, the bag 12 is retained open as shown in FIG. 10 for placing product such as the grapes 66 therein. Then, as depicted in FIG. 11, because the grapes 66 are relatively heavy the bag and grapes are supported on the shelf 72. This allows the operator to properly position the grapes 66 or other products as may be needed in the bag cavity 30 and, thus, further aids the operator in better and more easily handling the now filled bag. Thereafter the operator pulls the bag away from header 42 with a greater force sufficient for severing along the support sections 60 and fully severing the bag away from the header 42.

While this invention has been described as having specific embodiments, it will be understood that it is capable of further modifications. This application is therefore intended to cover any variations, uses, or adaptations of the invention following the general principles thereof and including such departures from the present disclosure as come within known or customary practice to the art to which this invention pertains and fall within the limits of the appended claims.

What is claimed is:

1. A process of placing product in a plastic film bag using a plastic film bag assembly including a plastic film bag having front and back walls defining a cavity therebetween and an opening leading to the cavity, a header portion extending from the back wall, a severance line extending across the header portion whereat the bag is selectively severable from the header portion, wherein the severance line includes a bag support section and a tear section, the severance line support section having a first strength per unit length of severance line and the tear section having a second strength per unit length of severance line and wherein the first strength per unit length is greater than the second strength per unit length, said process comprising:

grasping the bag front wall and pulling the front wall away from the header with a first force and severing the header along the severance line tear section;

placing product through the bag opening and in the bag cavity while the bag is attached to the header at the support section; and, further pulling the bag away from the header with a second force greater than the first force and severing the header along the severance line support section and thereby severing the bag from the header.

2. The process of claim 1 wherein the bag further includes complementary detachably attachable zipper profiles on the front and back walls near the bag opening for selectively opening and closing the bag and wherein the zipper profiles are at least partially attached to one another, said process further comprising, prior to the step of severing along the severance line support section, at least partially separating the complementary zipper profiles from one another.

3. The process of claim 2 wherein the bag front wall includes a lip and wherein, during said step of grasping and pulling, the lip is grasped.

4. The process of claim 1 wherein, after placing product in the bag cavity, the bag and product are supported on a support structure.

5. A process of placing product in a plastic film bag using a plastic film bag assembly including a plastic film bag having front and back walls defining a cavity therebetween and an opening leading to the cavity, a header portion extending from the back wall, a severance line extending across the header portion whereat the bag is selectively severable from the header portion, wherein the header portion includes side edges and the severance line extends therebetween, the severance line including tear sections adjacent each of the side edges and a support section therebetween, the severance line support section having a first strength per unit length of severance line and the tear section having a second strength per unit length of severance line and wherein the first strength per unit length is greater than the second strength per unit length, said process comprising:

grasping the bag front wall and pulling the bag away from the header with a first force and severing the header along the severance line tear sections;

placing product through the bag opening and in the bag cavity while the bag is attached to the header at the support section; and, further pulling the bag away from the header with a second force greater than the first force and severing the header along the severance line support section and thereby severing the bag from the header.

6. The process of claim 5 wherein the bag further includes complementary detachably attachable zipper profiles on the front and back walls near the bag opening for selectively opening and closing the bag and wherein the zipper profiles are at least partially attached to one another, said process further comprising, prior to the step of severing along the severance line support section, at least partially separating said complementary zipper profiles from one another.

7. The process of claim 6 wherein the bag front wall includes a lip and wherein, during the step of grasping and pulling, the lip is grasped.

8. The process of claim 5 wherein, after placing product in the bag cavity, the bag and product are supported on a support structure.

9. A process of placing product in a plastic film bag using a plastic film bag assembly including a plastic film bag having front and back walls defining a cavity therebetween and an opening leading to the cavity, a header portion extending from the back wall, a severance line extending across the header portion whereat the bag is selectively severable from the header portion, the severance line including sides tear sections adjacent each of the side edges, support sections adjacent each of the sides tear sections and a tear section between the support sections, the severance line support sections having a first strength per unit length of severance line and the tear line sections having a second strength per unit length of severance line and wherein the first strength per unit length is greater than the second strength per unit length, said process comprising:

grasping the bag front wall and pulling the bag away from the header with a first force and severing the header along the severance line tear sections;

placing product through the bag opening and in the bag cavity while the bag is attached to the header at the support sections;

further pulling the bag away from the header with a second force greater than the first force and severing the header along the severance line support sections; and, further pulling the bag away from the header and severing the header along the severance line tear section between the support sections thereby severing the bag from the header.

10. The process of claim 9 wherein the bag further includes complementary detachably attachable zipper profiles on the front and back walls near the bag opening for selectively opening and closing the bag and wherein the zipper profiles are at least partially attached to one another, said process further comprising, prior to the step of severing along the severance line support sections, at least partially separating the complementary zipper profiles from one another.

11. The process of claim 10 wherein the bag front wall includes a lip and wherein, during the step of grasping and pulling, said lip is grasped.

12. The process of claim 9 wherein, after placing product in the bag cavity, the bag and product are supported on a support structure.

* * * * *